United States Patent [19]

Kaufman et al.

[11] Patent Number: 4,620,664

[45] Date of Patent: Nov. 4, 1986

[54] COUPON BEARING CARTON CONSTRUCTION

[75] Inventors: George Kaufman; Ernest E. Lindlar, both of North Brunswick, N.J.

[73] Assignee: Church & Dwight Co., Inc., Princeton, N.J.

[21] Appl. No.: 764,315

[22] Filed: Aug. 9, 1985

[51] Int. Cl.[4] ..... B65D 5/54

[52] U.S. Cl. ..... 229/17 R; 206/626; 206/459; 206/831

[58] Field of Search ..... 206/459, 831, 607, 611, 206/612, 613, 625, 626, 631; 229/17 R, 39 B, 38; 40/312

[56] References Cited

U.S. PATENT DOCUMENTS

| | | | |
|---|---|---|---|
| 1,116,043 | 11/1914 | Elliott | 229/38 |
| 2,039,437 | 5/1936 | Moore | 229/17 R |
| 2,125,313 | 8/1938 | Ringler | 229/39 B |
| 2,358,923 | 9/1944 | Guyer | 229/17 R |
| 2,449,046 | 9/1948 | Barnes et al. | 229/17 R |
| 3,311,281 | 3/1967 | Eisman | 206/631 |
| 3,520,465 | 7/1970 | Spiering et al. | 229/17 R |
| 4,103,820 | 8/1978 | Mathison et al. | 206/459 |

*Primary Examiner*—George E. Lowrance
*Assistant Examiner*—Gary E. Elkins
*Attorney, Agent, or Firm*—Stiefel, Gross, Kurland & Pavane

[57] ABSTRACT

A carton construction for containing and dispensing an insert is disclosed. The insert is attached to the interior surface of a partially detachable tab. The insert so positioned can be removed from the container without destroying the integrity of the carton or disturbing its contents.

7 Claims, 8 Drawing Figures

COUPON BEARING CARTON CONSTRUCTION

TECHNICAL FIELD

This invention relates generally to a carton for packaging various types of bulk products, having a means for containing and dispensing an insert. In particular, the invention relates to a carton having a means for dispensing an insert disposed within the carton, e.g., an advertising premium, without destroying the integrity of the carton or disturbing its contents.

BACKGROUND ART

In the promotion of goods and services, oftentimes advertising materials including premium coupons are distributed to the consumer. Moreover, in the sale of products other printed material including warranty cards, instruction sheets, and the like are also distributed to the consumer. Various modes of distribution of these materials are employed by the manufacturer and/or the distributor of such products.

One such mode of distribution involves the placement of coupons in newspapers, magazines and the like. This mode of distribution is, however, very expensive. Another method of putting coupons, warranty cards, instruction sheets and other such printed materials in the hands of the consumer is to insert them directly into the package of the product sold by the advertiser. While this mode of distribution is inexpensive when compared to newspaper and magazine advertisement, it also presents a number of problems. One of the major problems relates to the fact that the insert material may not be readily removable from the package in which it is contained. Thus, in many cartons the insert material may be intermixed with the container contents. In order to remove the insert from the carton, the carton must be completely opened and, oftentimes, it is necessary to remove substantially the entire contents of the container before being able to locate and remove the insert material.

Mathison U.S. Pat. No. 4,103,820 discloses one form of a carton having a means for dispensing an insert therefrom. Specifically, Mathison discloses a carton having a coupon enclosed therein and glued to the interior surface of one of the minor or major flaps forming the top panel of the carton. While this particular carton construction makes it easier to locate the coupon, it is still necessary to completely open the carton to remove the insert material.

Niemeyer U.S. Pat. No. 3,443,682 also discloses a carton construction with means for dispensing an insert material. The carton disclosed by this patent has a pocket formed on the interior surface of one of the carton walls for holding a coupon. However, like the carton disclosed by Mathison, the Niemeyer carton has to be completely opened before the coupon can be located and removed.

See also Eilertsen U.S. Pat. No. 2,822,084 and Byrd U.S. Pat. No. 2,502,417 which disclose cartons for rolled materials such as surgical gauze. The cartons disclosed by both of these references have tabs which are used to help withdraw the contents, e.g. surgical gauze, from the container.

It is among the objects of this invention to provide an improved carton construction for holding an insert material, wherein the insert can be easily removed from the carton without completely opening the carton, destroying the integrity of the carton, or disturbing its contents.

SUMMARY OF THE INVENTION

The carton according to the present invention provides a means whereby an insert material may be removed from the carton without completely opening the carton and without disturbing the carton contents. This is achieved by adhering the insert material to the interior surface of a punch-out tab disposed on one of the wall panels of the carton. The insert material may be easily removed from the carton by simply punching out the tab and pulling the tab outwardly from the carton thereby withdrawing the insert material. The tab can thereafter be restored to its original position to completely close the carton.

In particular, the carton hereof comprises a pair of opposed face panels, a pair of opposed side panels connected to the respective face panels, a bottom panel joined to one end of each of the face and side panels for closing the bottom of the carton, and a top panel joined to the other end of each of the face and side panels for closing the top of the carton. One of the panels includes lines of perforation defining a partially detachable tab. The tab is movable outward from the plane of the panel when the lines of perforation are parted to define a dispensing opening for the carton. The carton also includes an insert detachably secured to the interior surface of the tab so that it extends into the interior of the carton. The insert is removable from the carton when the tab is partially detached from the carton and pulled outwardly therefrom. The insert may be removed from within the carton and detached from the tab without destroying the integrity of the carton and without disturbing the contents thereof. The tab retains its original form upon partial detachment from the carton so that it can be repositioned to close the opening in the carton when dispensing of the bulk material contained within the carton is no longer desired.

PREFERRED EMBODIMENTS OF THE INVENTION

Figure 2:
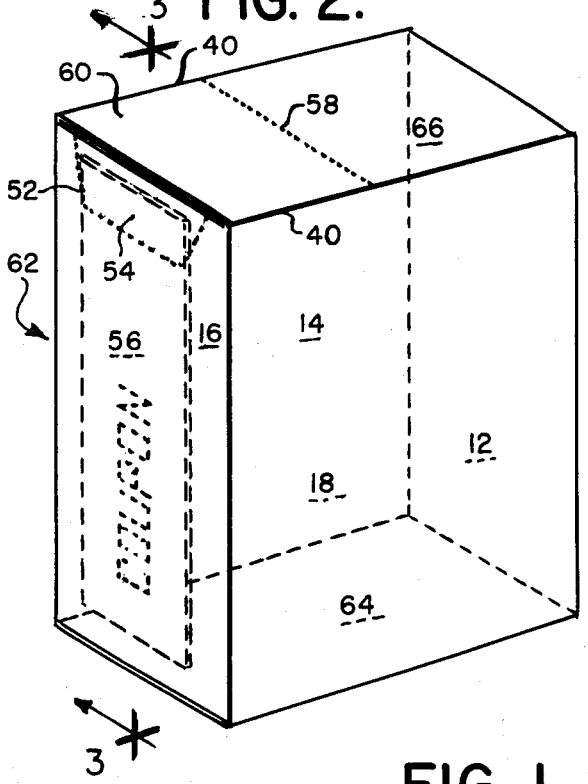
FIG. 2 is a perspective view of the carton assembled from the blank of FIG. 1, showing the carton as initially sealed.
Figure 1:
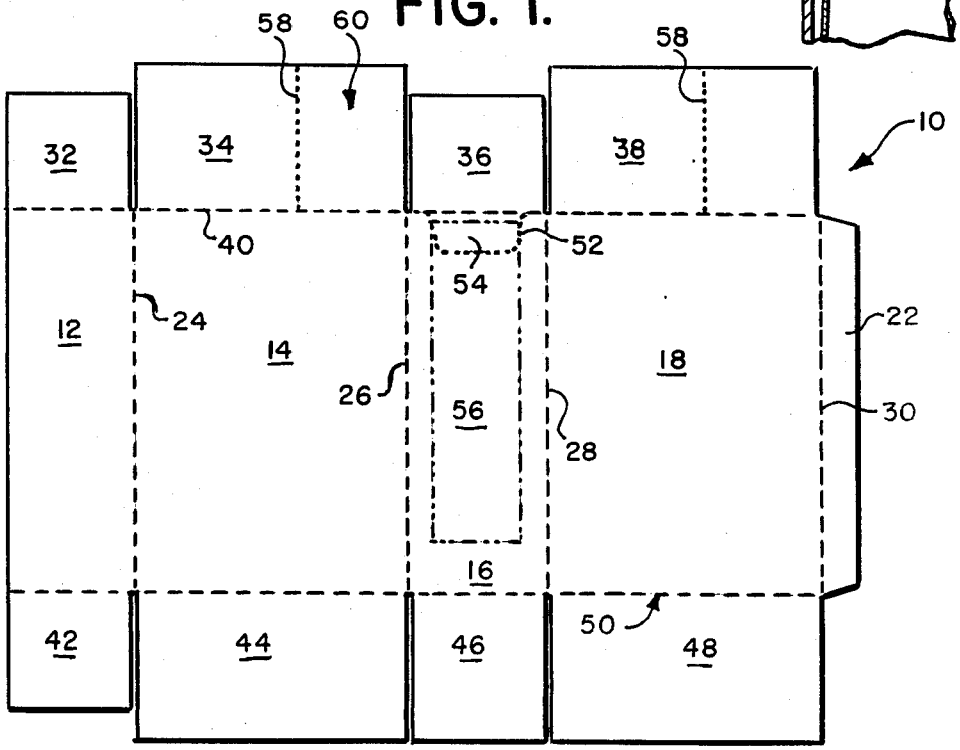
FIG. 1 is an interior plan view of a preferred embodiment of a carton blank as cut and scored for assembly of the insert-bearing carton of the invention.

Referring now to FIG. 1, a carton blank 10 embodying the present invention is formed and cut from a web or sheet of cardboard such as boxboard, paper board or other semi-rigid packaging material. The blank 10 illustrated in FIG. 1 is designed for erection into a rectangular carton (FIG. 2). The surface of the blank which ultimately becomes the interior surface of the resulting carton is illustrated in FIG. 1.

The carton blank 10 is shown as comprising a pair of opposed side panels including a right side panel 12 and a left side panel 16 (viewing FIG. 2), a pair of opposed face panels including a front panel 14 and a back panel 18, and a connecting flap 22 (manufacturer's glue flap) for securing the carton together by bonding the back panel 18 to the interior surface of right side panel 12. While any suitable method of bonding flap 22 to the right side panel 12 may be employed, adhesive bonding is presently preferred. As shown, the wall forming panels are connected to one another along fold lines 24, 26 and 28, with connecting flap 22 connected to back panel 18 along fold line 30. The fold lines 24, 26, 28 and 30 are preferably formed on the carton blank by vertically scoring the carton blank.

The carton blank 10 also includes a top inner minor flap 32, a top outer major flap 34, a top inner minor flap 36, and a top inner major flap 38 extending upwardly from the right side panel 12, front panel 14, left side panel 16 and back panel 18, respectively, of the blank. The respective flaps are separated from one another by cuts aligned with the vertical fold lines. As shown, a horizontal score line 40 is provided across the top extremities of the left side panel, front panel, right side panel and back panel of the blank 10, defining the fold lines along which the top flaps are joined to the panels.

The carton blank further includes a bottom inner minor flap 42, a bottom outer major flap 44, a bottom inner minor flap 46, and a bottom inner major flap 48. A horizontal score line 50 extends across the bottom extremities of the right side panel, back panel, left side panel, and front panel to form the fold lines along which the bottom flaps are joined to the panels.

As illustrated, the left side panel 16 is provided with lines of perforation 52 defining a partially detachable tab 54. As defined herein a line of perforation refers to a scored line which so weakens the surface upon which it is formed as to permit separation and detachment of a portion thereof. For example, the lines of perforation 52 may comprise series of spaced slits or perforations of any suitable type, of sufficient depth and continuity to so weaken the surface of the panel 16 upon which they are formed. The tab 54 is adapted to be partially detachable from the left side panel 16 by the application of moderate pressure by the hand or by the use of an appropriate tool. While the tab is shown as formed on the left side panel of the carton blank, it will be understood that it may be located on any of the other panels formed from the carton blank 10.

An insert 56, here shown as a printed coupon, is affixed or adhered to the interior surface of the tab 52. As defined herein, an insert refers to any one of a number of different pieces of printed matter which may be placed within or incorporated in a carton. The insert may be one or more sheets or it may take the form of folded-over sections of sheet material or the like. The insert may be a coupon such as may be redeemed in a store or mailed to a manufacturer, a receipt sheet, an instruction sheet, or other such printed material. The insert may compromise paper, cardboard, plastic film or the like.

While the insert may be adhered to the tab by any suitable method, spot gluing of the insert to the tab is presently preferred. Preferably, the spot gluing is done prior to assembly of the carton. To facilitate easy detachment of the insert from the tab, the insert may be provided with lines of perforations extending transversely across its surface near the point of attachment of the insert to the tab.

As illustrated, each of the top outer major flap 34 and top inner major flap 38 include a line of weakness 58 defining a partially detachable portion 60. As used herein, a line of weakness refers to a scored line which so weakens the surface upon which it is formed as to facilitate folding (but not ready separation or detachment) of a portion thereof. As described in greater detail below, detachable portion 60 is movable outwardly from the carton to define an opening for dispensing bulk material from the carton.

Prior to assembly of the carton blank 10 into the constructed carton 62, shown in FIG. 2, the blank is scored with fold lines, and cut. In addition, printing of the exterior surface of the blank 10 is usually preformed prior to construction of the carton 62.

While any suitable method of assembling the carton may be employed, it is presently preferred to assemble the carton as follows. Glue or a suitable adhesive is applied to the exterior surface of the connecting flap 22 and the carton blank is folded along lines 28 and 24 so that connecting flap 22 is positioned under the right side panel 12. The carton is then set up on a production line by forcing the knock-down carton into the open position (by mechanical fingers or a vacuum pick-off device) by folding along the four fold lines 24, 26, 28 and 30. The bottom inner minor flaps are then folded inwardly on one end of the carton. Preferably, the bottom inner minor flaps 42 and 46, respectively, are folded inwardly. Then, adhesive is applied to the outside of bottom inner major flap 48, or the inside surface of the bottom outer major flap 44. The bottom inner major flap 48 is then folded inwardly at right angles to the back panel. The bottom outer major flap 44 is then folded inwardly at a right angle to the front panel to form a bottom panel 64 comprised of the respective flaps 42, 44, 46 and 48, and thus define the carton.

With the carton structure thus partially formed, the contents are placed in the carton. The container may contain any type of bulk material including a powdery material, granulated material or the like. With the contents in place, the opposite top inner minor flaps (flaps 32 and 36) are folded inwardly. Adhesive is applied to the outside surface of the top inner major flap 38 or the inside surface of the top outer major flap 34. Flap 38 is then folded inwardly at right angles to the back panel over the inner minor flaps, and flap 34 is folded at right angles to the front panel of the carton. The thus folded and glued flaps thus define a top panel 66, completing the carton closure.

While the carton has been described as including a plurality of top and bottom flaps for defining end closures for the carton, it is within the teachings of this invention to have a single top panel and a single bottom panel for defining such end closures.

FIG. 2 illustrates the carton blank of FIG. 1 erected and constructed into carton 62. As shown in the embodiment illustrated the lines of perforation 52 defining the tab 54 are located at the upper extremities of left side panel 16. The insert 56 is shown in phantom as extending from tab 54 downwardly into the carton along left side panel 16. Also, as described in connection with FIG. 1, a line of weakness or foldline 59 extends transversely across the top outer major flap 34 and top inner major flap 38 defining a movable portion 60 of the top panel.

Figure 3:
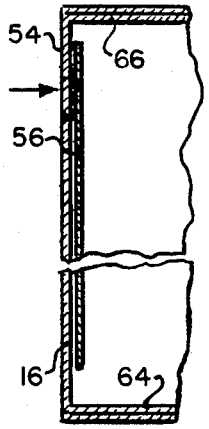
FIG. 3 is a fragmentary sectional view of the sealed carton, taken along line 3—3 in FIG. 2.
Figure 4:
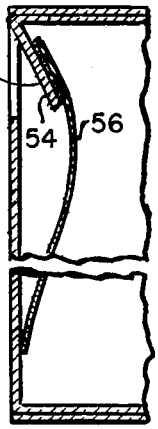
FIG. 4 is a fragmentary sectional view similar to FIG. 3, but showing the punch-out tab pushed into the interior of the carton.
Figure 5:
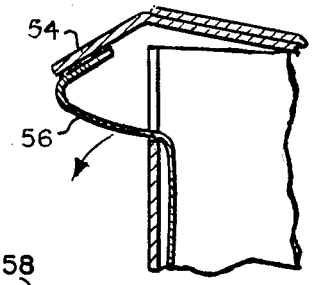
FIG. 5 is another fragmentary sectional view similar to FIG. 3, but showing the tab and top panel partially detached from the carton with the insert secured thereto and being partially removed from the interior of the carton.
Figure 6:
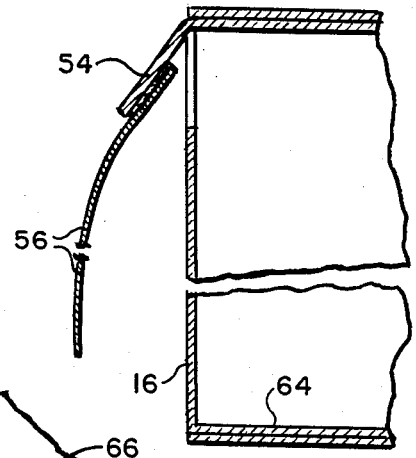
FIG. 6 is a further fragmentary sectional view similar to FIG. 3, but showing only the tab partially detached from the carton with the insert secured thereto and being totally removed from the interior of the cartons.

The successive stages in removing the insert from the carton and opening of the carton are illustrated in FIGS. 2–7 of the drawing. In FIGS. 2 and 3, the carton is shown completely closed. As shown, the insert 56 is attached to tab 54 and extends downwardly into the carton along left side panel 16. When it is desired to remove the insert without completely opening the carton, the punch-out tab is pushed inwardly (FIG. 4) by hand or with an appropriate tool. As illustrated in FIG. 6, the tab is thereafter pulled outwardly from the carton so as to remove the insert from the carton without completely opening the carton. The insert may then be removed by simply detaching it from the tab. When a tab is in the position shown in FIG. 6, there is a small opening in the left side panel 16 through which small quantities of the bulk material within the container may be dispensed. After removal of the insert, the tab may be repositioned over the opening formed in the left side panel so as to completely close the carton. In this manner, the insert may be removed without completely opening the container and without disturbing the contents of the container.

Figure 7:
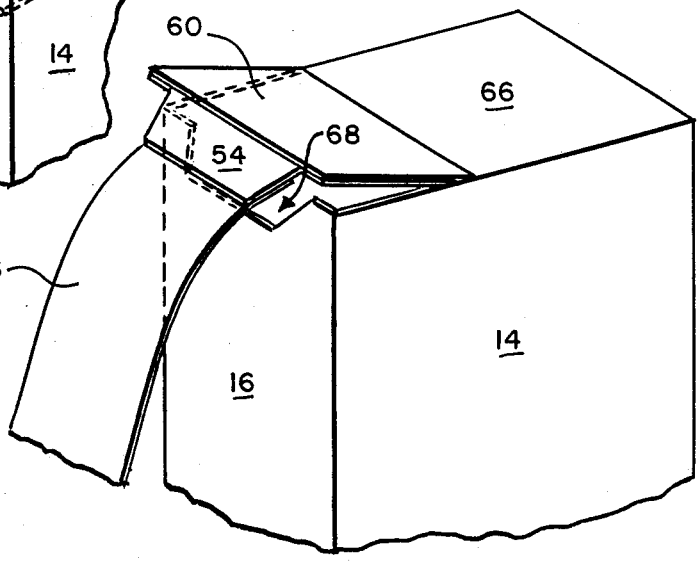
FIG. 7 is a fragmentary perspective view of the open carton similar to FIG. 5, but showing the insert totally removed from the interior of the carton.

If it is desired to completely open the carton, the punch-out tab 54 may be initially pushed inwardly and then pulled outwardly from the carton to the position shown in FIG. 6. The tab may then be pulled toward the right side panel 12, so as to rip the carton open along the score or fold lines 40 defining the movable portion 60 of the top panel 66 (FIGS. 5 and 7). Material within the carton may then be dispensed through the opening 68 thereby defined (FIGS. 5 and 7) in the side of the left side panel 16 and in the top panel 66 of the container.

Figure 8:
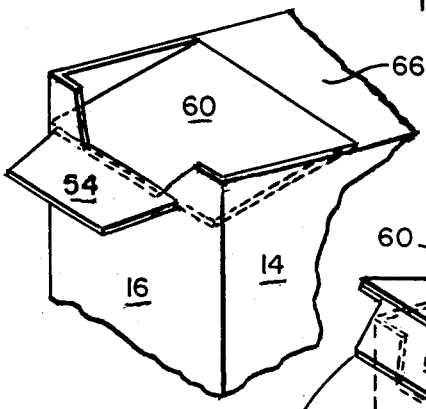
FIG. 8 is a fragmentary perspective view of the carton shown in FIGS. 5 and 7 in a closed position after it had been opened as shown in FIGS. 5 and 7.

After removal of the insert, the carton may be closed by positioning the tab in the opening formed in the left side panel, as shown in FIG. 8. Such positioning of the tab allows for easy reopening of the carton.

From the preceding it may be seen that an improved carton construction is provided in accordance with the present invention, which comprises a carton having a means for dispensing an insert disposed within the carton, without destroying the integrity of the carton or disturbing its contents. It will be understood that various changes may be made in the preferred embodiment described herein without departing from the spirit and scope of the invention. Accordingly, the preceding description is intended as illustrative only, the scope of the invention being determined solely by the claims appended hereto.

We claim:

1. A carton for containing and dispensing a bulk material, comprising:

(a) a pair of opposed face panels;

(b) a pair of opposed side panels connected to the respective face panels;

(c) a bottom panel joined to one end of each of said face and side panels for closing the bottom of the carton;

(d) a top panel joined to the other end of each of said face and side panels for closing the top of the carton, the top panel having a fold line extending transversely across the surface thereof;

(e) a partially detachable tab formed in one of said side or face panels adjacent said top panel proximate the fold line therein; the tab being defined by inwardly tapering side perforations extending downwardly from the edge of the top panel and adjoining base perforations extending generally transversely across a portion of the width of said one side or face panel, and the tab being movable outward from the plane of said one side or face panel when said lines of perforation are parted to define a dispensing opening for said carton; and (f) an insert detachably secured to the interior surface of said tab and extending adjacent to and lengthwise of said one side or face panel within said carton, said insert being drawn from said carton when said tab is partially detached from said carton and pulled outwardly therefrom and being detachable from said tab without being torn, destroying the integrity of the carton or disturbing the contents of the carton, and said tab retaining its form upon partial detachment from said carton so that it can be repositioned to close the opening in the carton when dispensing of said bulk material is no longer desired.

2. The carton of claim 1, wherein said pair of side panels includes a left side panel and a right side panel, and wherein said top panel comprises a plurality of flaps, said plurality of flaps including:

a first inner minor flap joined along a first fold line to said left side pahel;

a second inner minor flap joined along a second fold line to said right side panel;

an inner major flap joined along a third fold line to one of said face panels;

an outer major flap joined along a fourth fold line to the other of said face panels;

said lines of perforation being located on said left side panel;

said line of weakness extending transversely across the surfaces of said inner and outer major flaps and terminating at the third and fourth fold lines, whereby said carton may be opened by detaching and pulling outwardly from the carton said tab along with said first inner minor flap, said inner major flap and said outer major flap, thereby tearing said first inner minor flap and said inner and outer major flaps along said third and fourth fold lines to the point where said line of weakness intersects the third and fourth fold lines.

3. The carton of claim 1, wherein said tab is located on one of said face panels.

4. The carton of claim 1, wherein said insert is spot-glued to the interior surface of said tab.

5. The carton of claim 1, wherein said insert is a coupon.

6. The carton of claim 1, wherein said carton contains a bulk material dispensable therefrom.

7. The carton of claim 1, wherein the width of the insert is no greater than the length of the base perforations defining the tab.

* * * * *

UNITED STATES PATENT AND TRADEMARK OFFICE

CERTIFICATE OF CORRECTION

PATENT NO. : 4,620,664

DATED : November 4, 1986

INVENTOR(S) : George Kaufman et al.

It is certified that error appears in the above-identified patent and that said Letters Patent is hereby corrected as shown below:

Col. 5, line 5: "foldline" should read --fold line--.

Col. 5, line 5: "59" should read --58--.

Col. 6, line 35: "pahel;" should read --panel;--.

Signed and Sealed this

Tenth Day of May, 1988

*Attest:*

DONALD J. QUIGG

*Attesting Officer*

*Commissioner of Patents and Trademarks*